US010562302B2

(12) United States Patent
Yokoyama et al.

(10) Patent No.: US 10,562,302 B2
(45) Date of Patent: Feb. 18, 2020

(54) LIQUID EJECTING HEAD, LIQUID EJECTING APPARATUS, AND PIEZOELECTRIC DEVICE

(71) Applicant: SEIKO EPSON CORPORATION, Tokyo (JP)

(72) Inventors: Naoto Yokoyama, Matsumoto (JP); Masao Nakayama, Shiojiri (JP); Eiju Hirai, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/127,739

(22) Filed: Sep. 11, 2018

(65) Prior Publication Data

US 2019/0077148 A1 Mar. 14, 2019

(30) Foreign Application Priority Data

Sep. 13, 2017 (JP) ..... 2017-175584

(51) Int. Cl.
*B41J 2/14* (2006.01)

(52) U.S. Cl.
CPC ..... *B41J 2/14233* (2013.01); *B41J 2/14201* (2013.01); *B41J 2002/14306* (2013.01); *B41J 2002/14403* (2013.01)

(58) Field of Classification Search
CPC ..... B41J 2/14233; B41J 2002/14403; B41J 2002/14306
See application file for complete search history.

(56) References Cited

U.S. PATENT DOCUMENTS

| | | | | |
|---|---|---|---|---|
| 9,937,716 | B2 * | 4/2018 | Mikoshiba | B41J 2/1628 |
| 2005/0073557 | A1 | 4/2005 | Sugahara | |
| 2006/0139407 | A1 * | 6/2006 | Umeda | B41J 2/14274 347/54 |
| 2007/0126802 | A1 | 6/2007 | Shingyohuchi | |
| 2007/0171259 | A1 | 7/2007 | Kim et al. | |
| 2008/0186364 | A1 | 8/2008 | Sugahara et al. | |
| 2012/0320131 | A1 | 12/2012 | Kato et al. | |

FOREIGN PATENT DOCUMENTS

| | | | |
|---|---|---|---|
| JP | 2006035491 | A | 2/2006 |
| JP | 2009160841 | A | 7/2009 |
| JP | 2013-000993 | A | 1/2013 |
| JP | 2015020424 | A | 2/2015 |
| JP | 2017154439 | A | 9/2017 |

OTHER PUBLICATIONS

European Search Report issued in Application No. 18194326 dated Jan. 7, 2019.

* cited by examiner

*Primary Examiner* — Geoffrey S Mruk
(74) *Attorney, Agent, or Firm* — Workman Nydegger

(57) ABSTRACT

A liquid ejecting head includes a flow path substrate in which a nozzle through which liquid is ejected, a pressure chamber that communicates with the nozzle and a liquid supply chamber that communicates with the pressure chamber are formed, a vibration plate that is installed on the flow path substrate and overlaps with the pressure chamber and the liquid supply chamber, and a piezoelectric element that is formed on the vibration plate on an opposite side from the pressure chamber, in which a portion of the vibration plate overlapping with the pressure chamber is thinner in a thickness than a portion of the vibration plate overlapping with the liquid supply chamber.

19 Claims, 4 Drawing Sheets

LIQUID EJECTING HEAD, LIQUID EJECTING APPARATUS, AND PIEZOELECTRIC DEVICE

The entire disclosure of Japanese Patent Application No. 2017-175584, filed Sep. 13, 2017 is expressly incorporated by reference herein.

BACKGROUND

1. Technical Field

The present invention relates to a structure of a liquid ejecting head.

2. Related Art

An existing liquid ejecting head that ejects liquid in a pressure chamber through a nozzle by vibrating a vibration plate configuring a wall surface of the pressure chamber using a piezoelectric element has been proposed. For example, JP-A-2013-000993 discloses a configuration in which a flow path substrate in which an ink supply chamber, an individual flow path, and an individual liquid chamber are formed is covered by the vibration plate. An ink supply port with a filter function is formed in a portion of the vibration plate corresponding to the ink supply chamber, and the piezoelectric element is formed in a portion of the vibration plate corresponding to the individual liquid chamber.

SUMMARY

However, in the technique of JP-A-2013-000993, since the thickness of the vibration plate is constant over the entire area, it is difficult to achieve both of ensuring a displacement amount at the portion of the vibration plate corresponding to the individual liquid chamber and ensuring a strength at the portion of the vibration plate corresponding to the ink supply chamber. An advantage of some aspects of the invention is to ensure the strength of the vibration plate while ensuring the displacement amount of the vibration plate.

First Aspect

A liquid ejecting head according to an aspect (first aspect) of the invention includes a nozzle through which liquid is ejected, a flow path substrate in which a pressure chamber that communicates with the nozzle and a liquid supply chamber that communicates with the pressure chamber are formed, a vibration plate that is installed on the flow path substrate and overlaps with the pressure chamber and the liquid supply chamber, and a piezoelectric element that is formed on the vibration plate on an opposite side from the pressure chamber, in which a portion of the vibration plate overlapping with the pressure chamber is thinner in a thickness than a portion of the vibration plate overlapping with the liquid supply chamber. According to the above-described aspect, since the portion of the vibration plate overlapping with the pressure chamber is thinner in the thickness than the portion of the vibration plate overlapping with the liquid supply chamber, in comparison with a configuration in which the thickness of the vibration plate is constant regardless of a position of the vibration plate, a strength of the portion of the vibration plate overlapping with the liquid supply chamber can be ensured while ensuring a displacement amount of the portion of the vibration plate overlapping with the pressure chamber.

Second Aspect

In a preferable example (second aspect) according to the first aspect, it is preferable that the portion of the vibration plate overlapping with the liquid supply chamber include a filter section in which a plurality of through-holes is formed. According to the above-described aspect, since the vibration plate includes the filter section, bubbles, foreign matter, or the like included in the liquid can be captured. Additionally, since the vibration plate also functions as the filter section, in comparison with a configuration in which the filter section is provided as a different element from the vibration plate, a configuration of the liquid ejecting head is simplified.

Third Aspect

In a preferable example (third aspect) according to the first aspect or the second aspect, it is preferable that a recess section that is recessed in comparison with another portion be formed on a surface of the portion of the vibration plate overlapping with the pressure chamber on a side of the pressure chamber. According to the above-described aspect, since the recess section that is recessed in comparison with the other portion is formed on the surface of the portion of the vibration plate overlapping with the pressure chamber on the side of the pressure chamber, in comparison with a configuration in which a recess section is formed on a surface of the vibration plate on an opposite side from the pressure chamber, a capacity of the pressure chamber can be sufficiently ensured.

Fourth Aspect

In a preferable example (fourth aspect) according to the third aspect, it is preferable that a surface of the portion of the vibration plate overlapping with the liquid supply chamber on a side of the liquid supply chamber be formed of a compressive stress film, and the compressive stress film be not formed on the surface of the portion of the vibration plate overlapping with the pressure chamber on the side of the pressure chamber. According to the above-described aspect, since the surface of the portion of the vibration plate overlapping with the liquid supply chamber on the side of the liquid supply chamber is formed of the compressive stress film, and the compressive stress film is not formed on the surface of the vibration plate on the side of the pressure chamber, the portion of the vibration plate overlapping with the pressure chamber bends to the side of the piezoelectric element. Accordingly, in comparison with a configuration in which the surface of the vibration plate on the side of the liquid supply chamber is formed of a tensile stress film, and the tensile stress film is not formed on the surface on the side of the pressure chamber (that is, a configuration in which the vibration plate bends to the side of the pressure chamber), deterioration of the piezoelectric element can be suppressed.

Fifth Aspect

In a preferable example (fifth aspect) according to the third aspect, it is preferable that the surface of the portion of the vibration plate overlapping with the liquid supply chamber on the side of the liquid supply chamber be formed of a tensile stress film, and the tensile stress film be not formed on the surface of the portion of the vibration plate overlapping with the pressure chamber on the side of the pressure chamber. According to the above-described aspect, since the surface of the portion of the vibration plate overlapping with the liquid supply chamber on the side of the liquid supply chamber is formed of the tensile stress film, and the tensile stress film is not formed on the surface of the vibration plate on the side of the pressure chamber, the portion of the vibration plate overlapping with the pressure chamber bends to the side of the pressure chamber. Accordingly, in comparison with a configuration in which the surface of the vibration plate on the side of the liquid supply chamber is formed of the compressive stress film, and the compressive stress film is not formed on the surface on the side of the pressure chamber (that is, a configuration in which the vibration plate bends to the opposite side from the pressure chamber), a crack can be suppressed from being generated in the vibration plate.

Sixth Aspect

In a preferable example (sixth aspect) according to any one of the first aspect to the fifth aspect, it is preferable that a portion of the vibration plate in which the piezoelectric element is formed be thinner in a thickness over the entire area than the portion of the vibration plate overlapping with the liquid supply chamber. According to the above-described aspect, since the portion of the vibration plate in which the piezoelectric element is formed is thinner in the thickness over the entire area than the portion of the vibration plate overlapping with the liquid supply chamber, in comparison with a configuration in which the portion of the vibration plate in which the piezoelectric element is formed has a partially small thickness, a remarkable effect of ensuring the displacement amount of the portion of the vibration plate overlapping with the pressure chamber is obtained.

Seventh Aspect

A liquid ejecting apparatus according to an aspect (seventh aspect) of the invention includes the liquid ejecting head according to any one of the first aspect to the sixth aspect. Although a preferable example of the liquid ejecting apparatus is a printing apparatus that ejects ink, the application of the liquid ejecting apparatus according to an aspect of the invention is not limited to printing.

Eighth Aspect

A piezoelectric device according to an aspect (eighth aspect) of the invention that is provided in a liquid ejecting head that includes a flow path substrate in which a pressure chamber that communicates with a nozzle through which liquid is ejected and a liquid supply chamber that communicates with the pressure chamber are formed includes a vibration plate that is installed on the flow path substrate and overlaps with the pressure chamber and the liquid supply chamber, and a piezoelectric element that is formed on the vibration plate on an opposite side from the pressure chamber, in which a portion of the vibration plate overlapping with the pressure chamber is thinner in a thickness than a portion of the vibration plate overlapping with the liquid supply chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
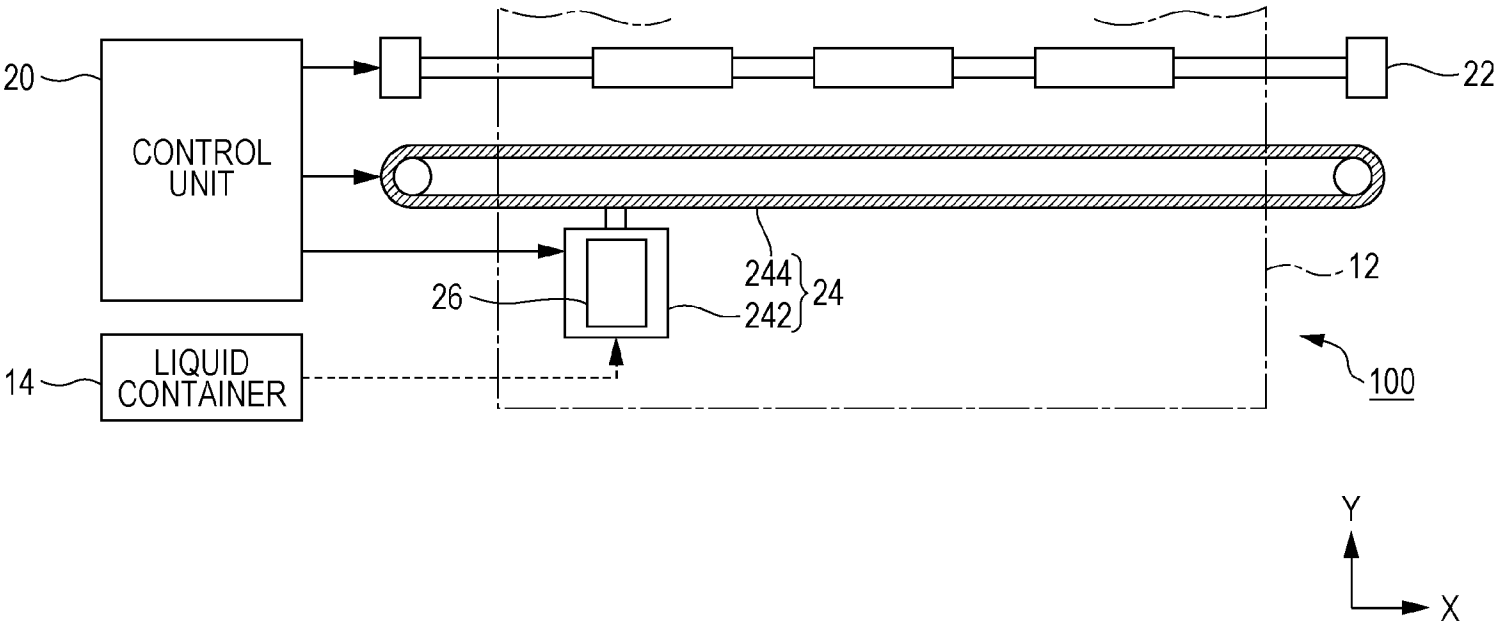
FIG. 1 is a configuration diagram of a liquid ejecting apparatus according to a first embodiment.

FIG. 1 is a configuration diagram illustrating a liquid ejecting apparatus 100 according to a first embodiment of the invention. The liquid ejecting apparatus 100 according to the first embodiment is an ink jet type printing apparatus that ejects ink that is an example of liquid to a medium (ejection target) 12. Although, typically, the medium 12 is printing paper, a target of printing made of an arbitrary material such as a resin film, a fabric, or the like is used as the medium 12. As illustrated in FIG. 1, the liquid ejecting apparatus 100 is provided with a liquid container 14 for storing the ink. For example, a cartridge attachable/detachable to/from the liquid ejecting apparatus 100, a bag-shaped ink pack formed of a flexible film, or an ink tank that can be replenished with the ink is used as the liquid container 14.

As illustrated in FIG. 1, the liquid ejecting apparatus 100 includes a control unit 20, a transport mechanism 22, a moving mechanism 24, and a liquid ejecting head 26. The control unit 20 includes, for example, a processing circuit such as a CPU (Central Processing Unit), an FPGA (Field Programmable Gate Array), or the like, and a storage circuit such as a semiconductor memory, and generally controls each element of the liquid ejecting apparatus 100. The transport mechanism 22 transports the medium 12 in a Y direction under the control of the control unit 20.

The moving mechanism 24 reciprocates the liquid ejecting head 26 in an X direction under the control of the control unit 20. The X direction is a direction that intersects with (typically, is orthogonal to) the Y direction in which the medium 12 is transported. The moving mechanism 24 according to the first embodiment includes a substantially box-shaped transport body 242 (carriage) for housing the liquid ejecting head 26, and a transport belt 244 to which the transport body 242 is fixed. Note that, a configuration in which a plurality of the liquid ejecting heads 26 is mounted in the transport body 242, or a configuration in which the liquid container 14 is mounted in the transport body 242 with the liquid ejecting head 26 may also be employed.

The liquid ejecting head 26 ejects ink supplied from the liquid container 14 to the medium 12 through a plurality of nozzles (ejection holes) N under the control of the control unit 20. By each liquid ejecting head 26 ejecting the ink to the medium 12 in parallel with the transport of the medium 12 by the transport mechanism 22 and the repetitive reciprocation of the transport body 242, a desired image is formed on a surface of the medium 12.

Figure 2:
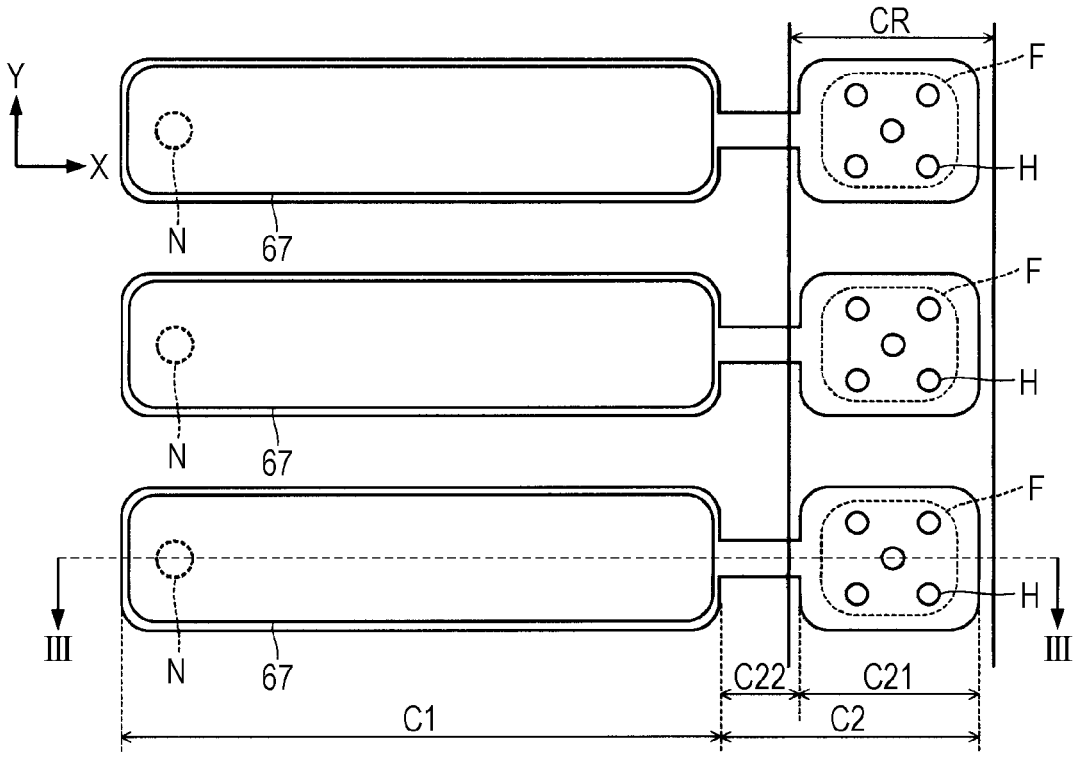
FIG. 2 is a plan view of a liquid ejecting head.
Figure 3:
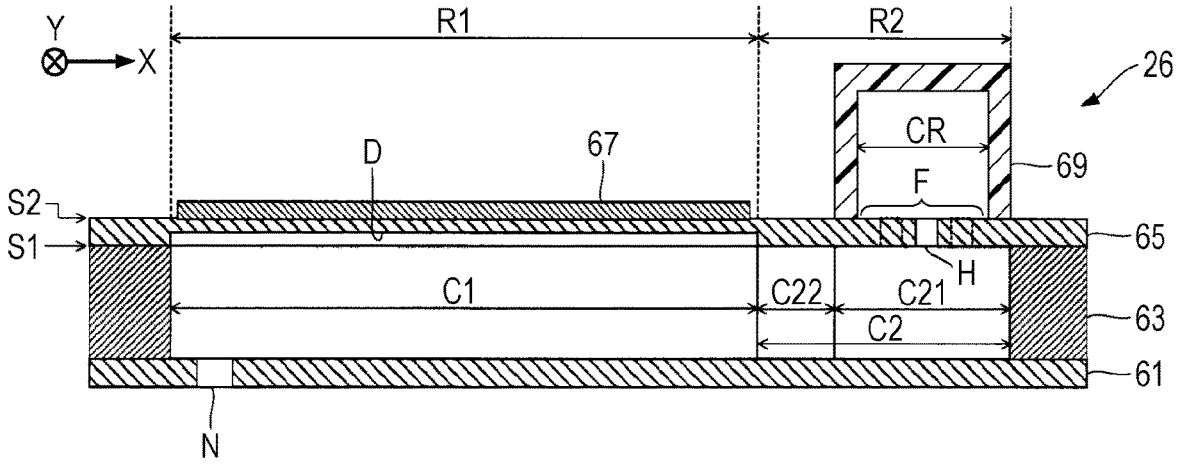
FIG. 3 is a cross-sectional view of the liquid ejecting head (the cross-sectional view taken along a line III-III in FIG. 2).

FIG. 2 is a plan view of the liquid ejecting head 26, FIG. 3 is a cross-sectional view of the liquid ejecting head 26 (a cross-sectional view taken along a line III-III in FIG. 2). Specifically, the liquid ejecting head 26 includes a nozzle plate 61, a flow path substrate 63, a vibration plate 65, a piezoelectric element 67, and a housing section 69.

The nozzle plate 61, the flow path substrate 63, and the vibration plate 65 are plate-shaped members that are long in the Y direction. As illustrated in FIG. 3, the nozzle plate 61 is installed on one surface of the flow path substrate 63, and the vibration plate 65 is installed on the other surface thereof. For example, the nozzle plate 61, the flow path substrate 63, and the vibration plate 65 are bonded to one another using an adhesive. The piezoelectric element 67 and the housing section 69 are installed on a surface of the vibration plate 65 on an opposite side from the flow path substrate 63. In the following description, a surface of the vibration plate 65 on the flow path substrate 63 side is expressed as a "first surface S1", and a surface of the vibration plate 65 on an opposite side from the flow path substrate 63 is expressed as a "second surface S2".

The nozzle plate 61 is a plate-shaped member in which the plurality of nozzles N arrayed in the Y direction is formed. Each of the nozzles N is a through-hole through which the ink is ejected. Note that, the nozzle plate 61 and the flow path substrate 63 are formed, for example, by processing a silicon (Si) single-crystal substrate through a semiconductor manufacturing technique such as etching or the like. Note that, any materials, any manufacturing methods, or the like may be employed for each element of the liquid ejecting head 26. The Y direction may also be rephrased as a direction in which the plurality of nozzles N is arrayed.

The flow path substrate 63 is a plate-shaped member for forming a flow path of the ink. As illustrated in FIG. 2 and FIG. 3, a pressure chamber (cavity) C1, a filter chamber C21, and a throttle section C22 are formed in the flow path substrate 63 for each of the nozzles N. The throttle section C22 is located between the pressure chamber C1 and the filter chamber C21. Each of the pressure chamber C1 and throttle section C22 has a long space along the X direction when viewed in a plan view. A width of the throttle section C22 in a plan view (a length in the Y direction) is narrower than widths of the pressure chamber C1 and the filter chamber C21. A length of the filter chamber C21 in a plan view (a length in the X direction) is shorter than a length of the pressure chamber C1. The pressure chamber C1 communicates with the nozzle N, and the throttle section C22 communicates with the pressure chamber C1 and the filter chamber C21. In other words, the filter chamber C21 communicates with the pressure chamber C1 through the throttle section C22. Note that, any shapes can be employed for each of the elements (C1, C21, and C22) of the flow path substrate 63. The vibration plate 65 installed on the flow path substrate 63 overlaps with the pressure chamber C1, the throttle section C22, and the filter chamber C21 in a plan view.

As illustrated in FIG. 3, the housing section 69 is installed on the vibration plate 65 on an opposite side from the filter chamber C21. The housing section 69 is, for example, a structural body manufactured through resin material injection molding, and is fixed to the second surface S2 of the vibration plate 65. In the housing section 69, a liquid storage chamber CR is formed. The liquid storage chamber CR is a common liquid chamber provided over the plurality of nozzles N (or a plurality of the pressure chambers C1), and stores the ink supplied from the liquid container 14. As illustrated in FIG. 2, the liquid storage chamber CR overlaps with the plurality of filter chambers C21 in a plan view.

As illustrated in FIG. 2 and FIG. 3, a portion of the vibration plate 65 overlapping with the filter chamber C21 includes a filter section F in which a plurality of through-holes H is formed. The filter section F is individually formed for each of the pressure chambers C1 (or for each of the nozzles N). A diameter of the through-hole H is, for example, smaller than the diameter of the nozzle N. The filter section F can capture bubbles, foreign matter, or the like included in the ink. The ink stored in the liquid storage chamber CR passes through the filter section F and is supplied to the filter chamber C21.

The filter chamber C21 is a space for supplying the ink to the pressure chamber C1, and stores the ink supplied from the liquid storage chamber CR. The ink stored in the filter chamber C21 is supplied to the pressure chamber C1 through the throttle section C22. The throttle section C22 is a space for ensuring flow path resistance, and functions as a flow path for causing the ink to flow from the filter chamber C21 to the pressure chamber C1. The filter chamber C21 and the throttle section C22 function as a liquid supply chamber C2 for supplying the ink to the pressure chamber C1. The liquid supply chamber C2 communicates with the pressure chamber C1. As is understood from the above description, the plurality of pressure chambers C1 is supplied with the ink stored in the liquid storage chamber CR through the liquid supply chambers C2, respectively, and filled with the ink, in parallel. As described above, the vibration plate 65 is installed on the flow path substrate 63, and overlaps with the pressure chamber C1 and the liquid supply chamber C2 (the throttle section C22 and the filter chamber C21). In the following description, a portion of the vibration plate 65 overlapping with the pressure chamber C1 is expressed as a "vibrating portion R1", and a portion of the vibration plate 65 overlapping with the liquid supply chamber C2 is expressed as a "fixing portion R2". The piezoelectric element 67 is installed in the vibrating portion R1, the filter section F is formed in the fixing portion R2 (specifically, in a portion overlapping with the filter chamber C21).

As illustrated in FIG. 3, the piezoelectric element 67 is installed on the vibration plate 65 on an opposite side from the pressure chamber C1 (that is, on the second surface S2 of the vibrating portion R1). The piezoelectric element 67 is individually formed for each of the pressure chambers C1 (or for each of the nozzles N). The piezoelectric element 67 is an actuator that deforms by a driving signal being supplied. As illustrated in FIG. 2, the piezoelectric element 67 that is slightly smaller than the pressure chamber C1 in a plan view is formed. A plurality of the piezoelectric elements 67 is arrayed in the Y direction so as to correspond to the plurality of pressure chambers C1, respectively. For example, the piezoelectric element 67 is configured by laminating a first electrode (lower electrode), a piezoelectric body layer, and a second electrode (upper electrode). A portion of the piezoelectric body layer interposed between the first electrode and the second electrode (a so-called active portion) deforms in accordance with a voltage difference between a reference voltage applied to the first electrode and the driving signal supplied to the second electrode. When the vibration plate 65 vibrates linked with the deformation of the piezoelectric element 67, by variation in the pressure in the pressure chamber C1, the ink with which the pressure chamber C1 is filled is ejected through the nozzle N. As is understood from the above description, a piezoelectric device is configured of the vibration plate 65 and the piezoelectric element 67.

Figure 4:
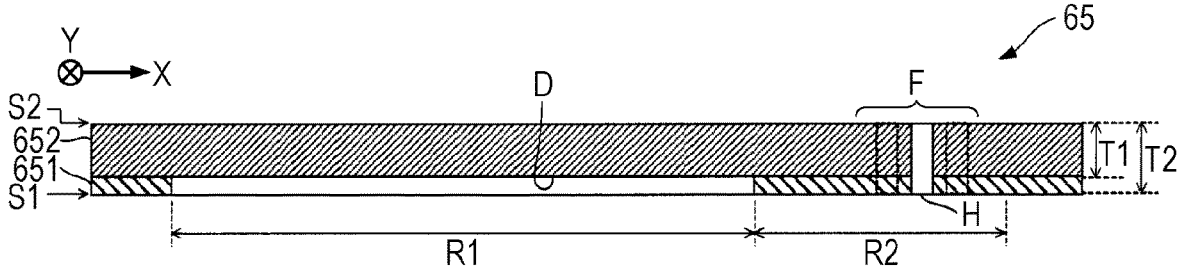
FIG. 4 is a cross-sectional view focusing on a vibration plate.

A specific configuration of the vibration plate 65 will be described in detail below. FIG. 4 is a cross-sectional view focusing on the vibration plate 65. As illustrated in FIG. 4, on a surface of the vibrating portion R1 on the pressure chamber C1 side, a recess section D that is recessed in comparison with other portions (for example, the fixing portion R2) is formed. In other words, a thickness (a length in a lamination direction) T1 of the vibrating portion R1 is smaller than a thickness T2 of the fixing portion R2. In the first embodiment, since the recess section D is formed over the entire area of the vibrating portion R1, the vibrating portion R1 is thinner in the thickness over the entire area than the fixing portion R2. In other words, the portion of the vibration plate 65 in which the piezoelectric element 67 is formed is thinner in the thickness over the entire area than the fixing portion R2.

As illustrated in FIG. 4, the vibration plate 65 is configured of a first layer 651 and a second layer 652. The first layer 651 and the second layer 652 are laminated from the flow path substrate 63 side in this order. Of the first layer 651, the first surface S1 is bonded to the flow path substrate 63, and a surface on an opposite side from the first surface S1 is bonded to the second layer 652. As illustrated in FIG. 4, by partially removing the first layer 651 in the vibrating portion R1, the recess section D is formed in the vibrating portion R1.

The first layer 651 is, for example, formed by forming a film of silicon oxide (for example, $SiO_2$) through chemical vapor deposition. The first layer 651 film-formed through the chemical vapor deposition of the silicon oxide is a compressive stress film with a compressive stress remaining in the inside. The second layer 652 is, for example, formed by laminating silicon (Si), polycrystalline silicon, amorphous silicon, silicon oxide, and silicon nitride (for example, $Si_3N_4$). The second layer 652 is formed using a known film formation technique. A film thickness of the first layer 651 is smaller than a film thickness of the second layer 652. By covering the surface of the second layer 652 with the first layer 651 after forming the second layer 652, and then selectively removing the first layer 651 in the vibrating portion R1 using a known processing technique such as etching or the like, the vibration plate 65 is formed. As is understood from the above description, the surface of the vibration plate 65 in the fixing portion R2 on the liquid supply chamber C2 side is formed of the compressive stress film, and the compressive stress film is not formed on the surface of the vibration plate 65 in the vibrating portion R1 on the pressure chamber C1 side.

Figure 5:
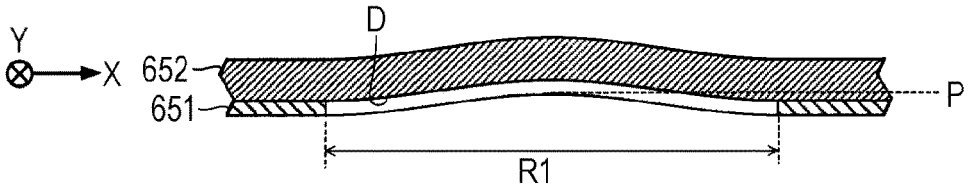
FIG. 5 is an enlarged view of a vibrating portion of the vibration plate.

FIG. 5 is an enlarged view of the vibrating portion R1 of the vibration plate 65. As described above, the first layer 651 according to the first embodiment is the compressive stress film. Accordingly, in a state where the first layer 651 is not removed, a tensile stress from the first layer 651 acts on a lower surface of the second layer 652 (a boundary surface between the first layer 651 and the second layer 652). In the first embodiment, by removing the first layer 651 in the vibrating portion R1, the tensile stress acting on the lower surface of the second layer 652 is reduced. Accordingly, as illustrated in FIG. 5, in a state where the piezoelectric element 67 is not supplied with the driving signal (hereinafter, referred to as a "non-driven state"), the vibration plate 65 is bent to the piezoelectric element 67 side such that the vibrating portion R1 is convex.

Figure 6:
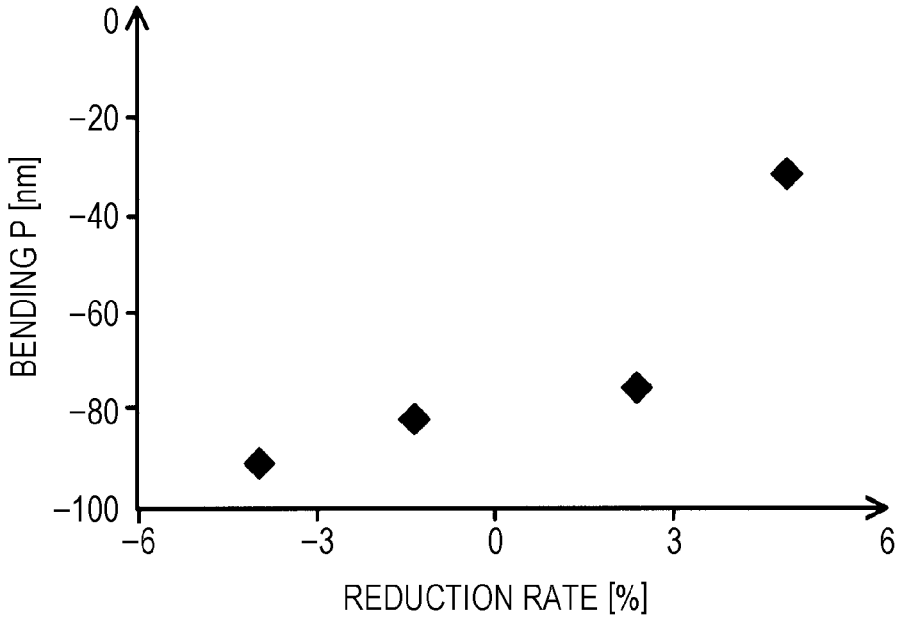
FIG. 6 is a graph showing a relationship between a bend of the vibrating portion in a non-driven state immediately after manufacture and a rate of reduction in an amplitude of the vibrating portion over time as the liquid ejecting head is used.

FIG. 6 is a graph showing a relationship between a bend (hereinafter, referred to as an "initial bend") P of the vibrating portion R1 in the non-driven state immediately after manufacture and a rate of reduction in an amplitude (that is, a displacement amount) of the vibrating portion R1 over time as the liquid ejecting head 26 is used (hereinafter, referred to as a "reduction rate"). FIG. 6 shows the initial bend with a state where the vibration plate 65 does not bend as a reference (0 nm). The graph shows that as the initial bend P is smaller than 0 nm, the vibrating portion bends to the pressure chamber C1 side, and as the initial bend P is larger than 0 nm, the vibrating portion bends to the piezoelectric element 67 side. Additionally, the reduction rate may also be rephrased as representation of a degree of deterioration of the piezoelectric element 67. As is seen from FIG. 6, knowledge that as the initial bend P is smaller than 0 nm, the reduction rate increases is obtained. In other words, as the vibrating portion R1 bends to the pressure chamber C1 side, the degree of the deterioration of the piezoelectric element 67 increases. In the first embodiment, since the vibrating portion R1 bends to the piezoelectric element 67 side in the non-driven state, the deterioration of the piezoelectric element 67 can be suppressed.

Here, in order to ensure the amplitude (displacement amount) of the vibrating portion R1, the vibration plate 65 is desirably thin in the thickness. On the other hand, in order to ensure a strength of the fixing portion R2, the vibration plate 65 is desirably thick in the thickness. Accordingly, in a configuration in which the thickness of the vibration plate 65 is constant regardless of a position in the vibration plate 65 (hereinafter, referred to as a "comparative example 1"), it is difficult to ensure the strength of the fixing portion R2 while ensuring the amplitude of the vibrating portion R1. In contrast, by the configuration according to the first embodiment in which the thickness T1 of the vibrating portion R1 is smaller than the thickness T2 of the fixing portion R2, it is possible to ensure the strength of the fixing portion R2 while ensuring the displacement amount of the vibrating portion R1. Additionally, since, by making the thickness T2 of the fixing portion R2 larger than that of the vibrating portion R1, the strength of the fixing portion R2 can be ensured, in comparison with a configuration in which a mechanical strength is ensured by forming an insulating layer on the second surface S2 of the fixing portion R2 in the comparative example 1, for example, the configuration of the liquid ejecting head 26 is simplified.

Second Embodiment

A second embodiment of the invention will be described. Note that, in each mode described as an example below, the elements whose actions or functions are the same as those in the first embodiment are given the reference numerals used in the description in the first embodiment, and detailed descriptions thereof will be appropriately omitted.

The first layer 651 according to the second embodiment is formed by forming a film of silicon nitride through chemical vapor deposition. The first layer 651 film-formed through the chemical vapor deposition of the silicon nitride is a tensile stress film with a tensile stress remaining in the inside. The second layer 652 according to the second embodiment is formed in the same manner as in the first embodiment, for example, by laminating silicon, polycrystalline silicon, amorphous silicon, silicon oxide, and silicon nitride. By covering the surface of the second layer 652 with the first layer 651 after forming the second layer 652, and then selectively removing the first layer 651 in the vibrating portion R1 using a known processing technique such as etching or the like, the vibration plate 65 is formed. As is understood from the above description, the surface of the vibration plate 65 in the fixing portion R2 on the liquid supply chamber C2 side is formed of the tensile stress film, and the tensile stress film is not formed on the surface of the vibration plate 65 in the vibrating portion R1 on the pressure chamber C1 side.

Figure 7:
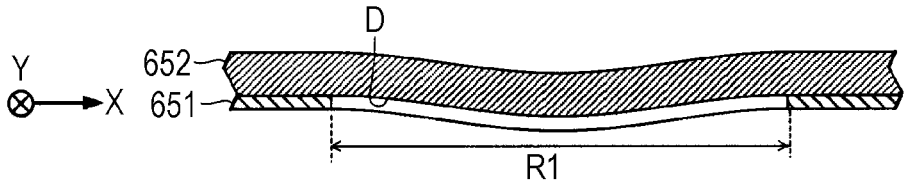
FIG. 7 is an enlarged view of the vibrating portion of the vibration plate according to a second embodiment.

FIG. 7 is an enlarged view of the vibrating portion R1 of the vibration plate 65 according to the second embodiment. As described above, the first layer 651 according to the second embodiment is the tensile stress film. Accordingly, in a state where the first layer 651 is not removed, a compressive stress from the first layer 651 acts on the lower surface of the second layer 652 (a boundary surface between the first layer 651 and the second layer 652). In the second embodiment, by removing the first layer 651 in the vibrating portion R1, the compressive stress acting on the lower surface of the second layer 652 is reduced. Accordingly, as illustrated in FIG. 7, in the non-driven state of the piezoelectric element 67, the vibration plate 65 bends to the pressure chamber C1 side such that the vibrating portion R1 is convex.

Here, in a state where the piezoelectric element 67 is supplied with the driving signal (hereinafter, referred to as a "driven state"), since a pressure from the ink is applied to the vibrating portion R1 (force of the ink for pushing up the vibration plate 65), the vibrating portion R1 bends to the piezoelectric element 67 side. Accordingly, in a case where the vibrating portion R1 bends to the piezoelectric element 67 side in the non-driven state of the piezoelectric element 67 (hereinafter, referred to as a "comparative example 2"), the bend to the piezoelectric element 67 side is further increased in the driven state (that is, a degree of the deformation of the vibration plate 65 increases). Accordingly, in the vicinity of boundary between the portion that is bonded and the portion that is not bonded (typically, the vibrating portion R1) to the flow path substrate 63, of the vibration plate 65 in the comparative example 2, a crack is easy to be generated. In the second embodiment, since the vibrating portion R1 bends to the pressure chamber C1 side in the non-driven state of the piezoelectric element 67, in comparison with the comparative example 2, the crack can be suppressed from being generated in the vibration plate 65.

In the second embodiment as well, in the same manner as in the first embodiment, the strength of the fixing portion R2 can be ensured while ensuring the displacement amount of the vibrating portion R1. Additionally, by making the fixing portion R2 thicker in the thickness than the vibrating portion R1, the strength of the fixing portion R2 can be ensured, the configuration of the liquid ejecting head 26 can be simplified.

Variation

Each mode described above may be variously modified. Specific modification aspects that may be applied to each mode described above will be described below as an example. Note that, two or more aspects arbitrarily selected from examples described below may appropriately be combined in a range in which they are not inconsistent with each other.

1. In the first embodiment, although the first layer 651 is formed by film-forming of the silicon oxide through the chemical vapor deposition, the formation method and the material of the first layer 651 are not limited to the above-described example. Further, in the second embodiment, although the first layer 651 is formed by film-forming of the silicon nitride through the chemical vapor deposition, the formation method and the material of the first layer 651 are not limited to the above-described example. It is not essential that the compressive stress or the tensile stress remains in the first layer 651.

2. In each mode described above, although the configuration in which the fixing portion R2 includes the filter section F is described as an example, whether to provide the filter section F in the fixing portion R2 is optional. Note that, according to the configuration in which the fixing portion R2 includes the filter section F, bubbles, foreign matter, or the like included in the ink can be captured. Additionally, since the vibration plate 65 also functions as the filter section F, in comparison with the configuration in which the filter section F is provided as a different element from the vibration plate 65, the configuration of the liquid ejecting head 26 is simplified.

3. In each mode described above, although the configuration in which the recess section D is formed on the surface of the vibrating portion R1 on the pressure chamber C1 side (that is, the first surface S1) is described as an example, a specific shape of the vibration plate 65 may be changed as desired as long as the vibrating portion R1 is thinner in the thickness than the fixing portion R2. For example, the recess section D that is recessed in comparison with other portions may be formed on the surface of the vibrating portion R1 on the piezoelectric element 67 side (that is, the second surface S2). In the configuration in which the vibrating portion R1 is thinner in the thickness than the fixing portion R2, an effect that the strength of the fixing portion R2 can be ensured while ensuring the displacement amount of the vibrating portion R1 is achieved. Note that, according to the configuration in which the recess section D is formed on the surface of the vibrating portion R1 on the pressure chamber C1 side, in comparison with the configuration in which the recess section D is formed on the surface of the vibrating portion R1 on the piezoelectric element 67 side, a capacity of the pressure chamber C1 can be sufficiently ensured.

4. In each mode described above, although the vibration plate 65 is configured of the first layer 651 and the second layer 652, the structure of the vibration plate 65 is not limited to the above-described example. For example, the vibration plate 65 may be formed as a single layer. For example, by film-forming any one or both of silicon oxide and silicon nitride through the chemical vapor deposition, the vibration plate 65 may be formed. Alternatively, by laminating silicon, polycrystalline silicon, amorphous silicon, silicon oxide, silicon nitride, or the like, the vibration plate 65 may be formed.

5. In the first embodiment, although the configuration in which the surface of the fixing portion R2 on the liquid supply chamber C2 side is formed of the compressive stress film, and the compressive stress film is not formed on the surface of the vibrating portion R1 on the pressure chamber C1 side is described as an example, types of the surfaces of the vibrating portion R1 and the fixing portion R2 on the flow path substrate 63 side are not limited to the above-described configuration. For example, a configuration in which the compressive stress film is formed on the surfaces of both the vibrating portion R1 and the fixing portion R2, or a configuration in which a film other than the compressive stress film is formed on the surfaces of both the vibrating portion R1 and the fixing portion R2 may also be employed. Note that, by the configuration according to the first embodiment in which the surface of the fixing portion R2 on the liquid supply chamber C2 side is formed of the compressive stress film, and the compressive stress film is not formed on the surface of the vibrating portion R1 on the pressure chamber C1 side, the vibrating portion R1 bends to the piezoelectric element 67 side. Accordingly, as described in the first embodiment, in comparison with the configuration in which the surface of the fixing portion R2 on the liquid supply chamber C2 side is formed of the tensile stress film (that is, the configuration in which the vibrating portion R1 bends to the flow path substrate 63 side), the deterioration of the piezoelectric element 67 can be suppressed.

6. In the second embodiment, although the configuration in which the surface of the fixing portion R2 on the liquid supply chamber C2 side is formed of the tensile stress film, and the tensile stress film is not formed on the surface of the vibration plate 65 in the vibrating portion R1 on the pressure chamber C1 side is described as an example, types of the surfaces of the vibrating portion R1 and the fixing portion R2 on the flow path substrate 63 side are not limited to the above-described configuration. For example, a configuration in which the tensile stress film is formed on the surfaces of both the vibrating portion R1 and the fixing portion R2, or a configuration in which a film other than the tensile stress film is formed on the surfaces of both the vibrating portion R1 and the fixing portion R2 may also be employed. Note that, by the configuration according to the second embodiment in which the surface of the fixing portion R2 on the liquid supply chamber C2 side is formed of the tensile stress film, and the tensile stress film is not formed on the surface of the vibration plate 65 in the vibrating portion R1 on the pressure chamber C1 side, the vibrating portion R1 bends to the pressure chamber C1 side. Accordingly, as described in the second embodiment, in comparison with the configuration in which the surface of the fixing portion R2 on the liquid supply chamber C2 side is formed of the compressive stress film (that is, the configuration in which the vibrating portion bends to the piezoelectric element 67 side), the crack can be suppressed from being generated in the vibration plate 65.

7. In each mode described above, although the recess section D is formed by removing the first layer 651 at the vibrating portion R1, the formation method of the recess section D is not limited to the above-described example. For example, the recess section D may be formed by partially removing the first layer 651 in the vibrating portion R1 in the thickness direction. Additionally, the recess section D may be formed by removing the first layer 651 and a part of the second layer 652 in the thickness direction. In other words, any depth of the recess section D formed in the vibrating portion R1 may be used.

8. In each mode described above, although the configuration in which the portion of the vibration plate 65 in which the piezoelectric element 67 is formed is thinner in the thickness over the entire area than the fixing portion R2 is described as an example, the portion of the vibration plate 65 in which the piezoelectric element 67 is formed may partially be thinner in the thickness than the fixing portion R2. Note that, according to the configuration in which the portion of the vibration plate 65 in which the piezoelectric element 67 is formed is thinner in the thickness over the entire area than the fixing portion R2, in comparison with the configuration in which the portion of the vibration plate 65 in which the piezoelectric element 67 is formed is partially thin in the thickness, a more remarkable effect of ensuring the displacement amount of the vibrating portion R1 is obtained.

9. In each mode described above, although the configuration in which the vibrating portion R1 is thinner in the thickness over the entire area than the fixing portion R2 is described as an example, the vibrating portion R1 may partially be thinner in the thickness than the fixing portion R2. For example, a range in which the thickness is made to be smaller than that of the fixing portion R2 may arbitrarily be changed in accordance with the size of the piezoelectric element 67.

10. In each mode described above, although the liquid supply chamber C2 is configured of the filter chamber C21 and the throttle section C22, a specific configuration of the liquid supply chamber C2 is not limited to the above-described example. For example, the liquid supply chamber C2 may be configured only of the filter chamber C21.

11. In each mode described above, although the serial type liquid ejecting apparatus 100 that reciprocates the transport body 242 in which the liquid ejecting head 26 is mounted is described as an example, the invention can also be applied to a line type liquid ejecting apparatus in which the plurality of nozzles N is distributed over the entire width of the medium 12.

12. The liquid ejecting apparatus 100 described as an example in each mode described above may be employed in various types of apparatuses such as a facsimile machine, a copying machine, or the like, in addition to an apparatus dedicated to printing. Understandably, the application of the liquid ejecting apparatus according to the invention is not limited to printing. For example, the liquid ejecting apparatus that ejects a color material solution is used as a manufacturing apparatus for forming a color filter of a liquid crystal display device. Additionally, the liquid ejecting apparatus that ejects a solution of a conductive material is used as a manufacturing apparatus for forming a wire or an electrode of a wiring substrate.

What is claimed is:

1. A liquid ejecting head comprising:

a nozzle through which liquid is ejected;

a flow path substrate in which a pressure chamber and a liquid supply chamber are formed, the pressure chamber communicating with the nozzle, and the liquid supply chamber communicating with the pressure chamber;

a housing section in which a liquid storage chamber is formed, the storage chamber storing liquid and communicating with the liquid supply chamber;

a vibration plate that is installed on the flow path substrate; and a piezoelectric element that is formed on the vibration plate on an opposite side from the pressure chamber, wherein the vibration plate overlaps both the pressure chamber in the flow path substrate and the liquid storage chamber in the housing section, and wherein a portion of the vibration plate overlapping with the pressure chamber is thinner in a thickness than a portion of the vibration plate overlapping with the liquid storage chamber.

2. The liquid ejecting head according to claim 1, wherein the portion of the vibration plate overlapping with the liquid storage chamber includes a filter section in which a plurality of through-holes is formed.

3. A liquid ejecting apparatus comprising:

the liquid ejecting head according to claim 2.

4. The liquid ejecting head according to claim 2, wherein a first through-hole and a second through-hole out of the plurality of through-holes are formed at different positions in both an X direction and a Y direction, the Y direction being orthogonal to the X direction.

5. The liquid ejecting head according to claim 1, wherein a recess section that is recessed in comparison with another portion is formed on a surface of the portion of the vibration plate overlapping with the pressure chamber on a side of the pressure chamber.

6. The liquid ejecting head according to claim 3, wherein a surface of the portion of the vibration plate overlapping with the liquid supply chamber on a side of the liquid supply chamber liquid storage chamber is formed of a compressive stress film, and the compressive stress film is not formed on the surface of the portion of the vibration plate overlapping with the pressure chamber on the side of the pressure chamber.

7. A liquid ejecting apparatus comprising:

the liquid ejecting head according to claim 6.

8. The liquid ejecting head according to claim 3, wherein the surface of the portion of the vibration plate overlapping with the liquid supply chamber on the side of liquid storage chamber is formed of a tensile stress film, and the tensile stress film is not formed on the surface of the portion of the vibration plate overlapping with the pressure chamber on the side of the pressure chamber.

9. A liquid ejecting apparatus comprising:

the liquid ejecting head according to claim 8.

10. A liquid ejecting apparatus comprising:

the liquid ejecting head according to claim 5.

11. The liquid ejecting head according to claim 1, wherein a portion of the vibration plate at which the piezoelectric element is formed is thinner in a thickness over an entire area than the portion of the vibration plate overlapping with the liquid supply chamber.

12. A liquid ejecting apparatus comprising:

the liquid ejecting head according to claim 11.

13. A liquid ejecting apparatus comprising:

the liquid ejecting head according to claim 1.

14. The liquid ejecting head according to claim 1, wherein the filter section of the vibration plate comprises a first layer and a second layer, the first layer being closer to the flow path substrate than the second layer.

15. The liquid ejecting head according to claim 14, wherein the portion of the vibration plate overlapping with the pressure chamber consists from the second layer and does not consist from the first layer, and wherein the portion of the vibration plate overlapping with the liquid storage chamber consists from both the first layer and the second layer.

16. The liquid ejecting head according to claim 14, wherein the portion of the vibration plate overlapping with the liquid storage chamber includes a filter section in which a through-hole is formed, and wherein the through-hole passes through both the first layer and the second layer.

17. The liquid ejecting head according to claim 1, wherein the housing section stacks on the vibration plate.

18. A piezoelectric device that is provided in a liquid ejecting head that includes a flow path substrate in which a pressure chamber and a liquid supply chamber are formed, the pressure chamber communicating with a nozzle and the supply chamber communicating with the pressure chamber, the ejecting head further including a housing section in which a liquid storage chamber is formed, the storage chamber storing liquid and communicating with the liquid supply chamber, the piezoelectric device comprising:

a vibration plate that is installed on the flow path substrate; and a piezoelectric element that is formed on the vibration plate on an opposite side from the pressure chamber, wherein the vibration plate overlaps both the pressure chamber in the flow path substrate and the liquid storage chamber in the housing section, and wherein a portion of the vibration plate overlapping with the pressure chamber is thinner in a thickness than a portion of the vibration plate overlapping with liquid storage chamber.

19. The liquid ejecting head according to claim 18, wherein the filter section of the vibration plate comprises a first layer and a second layer, the first layer being closer to the flow path substrate than the second layer.

* * * * *